US005261664A

United States Patent [19]

Anderson

[11] Patent Number: 5,261,664

[45] Date of Patent: Nov. 16, 1993

[54] GOLF CLUB HEAD AND METHOD OF FORMING SAME

[76] Inventor: Donald Anderson, 6600 Werner Ave. #150, Huntington Beach, Calif. 92648

[21] Appl. No.: 897,005

[22] Filed: Jun. 11, 1992

Related U.S. Application Data

[63] Continuation-in-part of Ser. No. 806,348, Dec. 13, 1991, which is a continuation-in-part of Ser. No. 549,973, Jul. 9, 1990, Pat. No. 5,094,383, which is a continuation-in-part of Ser. No. 492,973, Mar. 13, 1990, Pat. No. 5,024,437, which is a continuation-in-part of Ser. No. 364,698, Jun. 12, 1989, abandoned.

[51] Int. Cl.[5] ..... A63B 53/04

[52] U.S. Cl. ..... 273/78; 273/167 H; 273/173

[58] Field of Search ..... 273/167 R–77 A, 273/79, 164.1, 162 R, 193 R, 194 R, DIG. 23

[56] References Cited

U.S. PATENT DOCUMENTS

| | | | |
|---|---|---|---|
| 1,257,471 | 2/1918 | Fitzjohn et al. | 273/173 |
| 1,359,220 | 11/1920 | Beamer | 273/78 |
| 1,463,533 | 7/1923 | Kurz, Jr. | 273/173 |
| 1,589,363 | 6/1926 | Butchart | 273/173 X |
| 1,665,523 | 4/1928 | Boyce | 273/173 X |
| 2,034,936 | 3/1936 | Barnhart | 273/78 |
| 2,447,967 | 8/1948 | Stone | 273/77 R |
| 2,517,245 | 8/1950 | Scott | 273/77 R |
| 3,218,072 | 11/1965 | Burr | 273/78 |
| 3,387,844 | 6/1968 | Shippee | 273/77 R |
| 3,970,236 | 7/1976 | Rogers | 273/173 |
| 4,027,885 | 6/1977 | Rogers | 273/169 |
| 4,252,262 | 2/1981 | Igarashi | 273/173 |
| 4,398,965 | 8/1983 | Campau | 273/78 X |
| 4,429,879 | 2/1984 | Schmidt | 273/167 H |
| 4,438,931 | 3/1984 | Motomiya | 273/167 H |
| 4,465,221 | 8/1984 | Schmidt | 273/173 X |
| 4,534,558 | 8/1985 | Yoneyama | 273/78 |
| 4,749,197 | 6/1988 | Orlowski | 273/173 |
| 4,768,787 | 9/1988 | Shira | 273/175 |
| 4,792,140 | 12/1988 | Yamaguchi et al. | 273/173 |
| 4,809,978 | 3/1989 | Yamaguchi et al. | 273/78 |
| 4,824,116 | 4/1989 | Nagamoto et al. | 273/171 |
| 5,024,437 | 6/1991 | Anderson | 273/78 |
| 5,094,383 | 3/1992 | Anderson et al. | 228/176 |

FOREIGN PATENT DOCUMENTS

| | | | |
|---|---|---|---|
| 211781 | 12/1957 | Australia | 273/167 F |
| 627474 | 9/1987 | Japan . | |
| 6485679 | 3/1989 | Japan . | |
| 3822 | 11/1893 | United Kingdom . | |
| 15376 | 10/1903 | United Kingdom . | |
| 15260 | 7/1904 | United Kingdom . | |
| 243435 | 11/1925 | United Kingdom . | |
| 267755 | 3/1927 | United Kingdom . | |
| 442557 | 2/1936 | United Kingdom | 273/80 R |
| 1227948 | 4/1971 | United Kingdom . | |
| 2146249 | 4/1985 | United Kingdom . | |

OTHER PUBLICATIONS

PCT/US91/01668 filed Mar. 12, 1991, Gear Fit Golf, Inc.

Dennis, Larry "What Irons Are Best for You—Forged or Cast?" *Golf Digest*, Jan, 1975, pp. 40–46.

*Primary Examiner*—V. Millin
*Assistant Examiner*—Sebastiano Passaniti
*Attorney, Agent, or Firm*—William W. Haefliger

[57] ABSTRACT

A golf club head comprising a main body portion formed by an investment casting of a first metallic material; a face plate formed of a second high-strength metallic material; and structure including fasteners joining the periphery of the face plate to ledges on the main body portion to form a high strength, face plate for the golf club head.

19 Claims, 2 Drawing Sheets

GOLF CLUB HEAD AND METHOD OF FORMING SAME

BACKGROUND OF THE INVENTION

This application is a continuation-in-part of Ser. No. 806,348, filed Dec. 13, 1991; which is a continuation-in-part of application Ser. No. 549,973, filed Jul. 9, 1990 now U.S. Pat. No. 5,094,383; which is a continuation-in-part of application Ser. No. 492,973, filed Mar. 13, 1990, now U.S. Pat. No. 5,024,437, issued Jun. 18, 1991; which is a CIP of Ser. No. 364,698, filed Jun. 12, 1989, now abandoned. All of such applications and resulting patents are incorporated herein by reference.

This invention relates to golf clubs, and more particularly to an improved face plate construction for and attachment to a golf club head.

The heads of golf clubs are generally formed as a one-piece casting of durable materials, such as stainless steel, beryllium copper, aluminum, etc. A head of this type is described in U.S. Pat. No. 4,021,047 issued May 3, 1977, to R. J. Mader. The use of face plates made of a different material than that of the main body of the club head has been disclosed in the prior art in both irons and "wood"-type drivers, which are often made of cast metal. Such prior art club heads are described in U.S. Pat. No. 4,792,140 issued Dec. 20, 1988, to Yamaguchi et al.; U.S. Pat. No. 4,534,558 issued Aug. 13, 1985, to Yoneyama; U.S. Pat. No. 3,218,072 issued Nov. 16, 1965, to Burr; and British Patent No. 1.227.948 issued Apr. 15, 1971, to Haines et al.

In the heads of these prior art patents, the face plate is of a plastic material, such as a resin or a carbon fiber composite. There is need for a high-strength, controlled thickness, metallic face plate of selected composition, at the face of the head, the head itself consisting of metal.

SUMMARY OF THE INVENTION

It is a major object of the invention to provide an improved golf club head, comprising:

a) a main body portion formed by an investment casting of a first metallic material, b) a face plate formed of a second high-strength metallic material, c) and means including fasteners joining the periphery of the face plate to ledges on the main body portion to form a high strength, face plate for the golf club head.

As will appear, the first cast material is typically selected from the group consisting of steel, titanium, beryllium, copper, and aluminum; and the face plate may be forged, or cast, and consist of a material selected from that same group.

It is another important object of the invention to provide the main body portion of the metallic head (which is typically hollow) with local ledges or bosses that protrude into registration with the fasteners which are connected to such ledges or bosses, whereby the thickness of the head walls need not be increased to receive the fasteners. The face plate itself may be rearwardly seated against such bosses, and the face plate periphery is closely fitted into an opening defined by the head main body portion. Also, the fasteners may be welded to the face plate, after their connection to the ledges or bosses, locking them in position.

A further object is to provide the face plate with a generally trapezoidal periphery, with an upper edge that is convex upwardly, the fasteners including two upper fasteners located near the upper edge and spaced apart in a head toe-to-heel direction. In this regard, the face plate typically has a lower edge which is generally convex downwardly, the fastener including two lower fasteners located near the lower edge and spaced apart in a head toe-to-head direction.

The fasteners may desirably include two upper fasteners which are spaced apart, and two lower fasteners which are spaced apart, generally above one of the lower fasteners.

The method of forming a high-strength, metallic, golf club head in accordance with the invention includes:

a) casting a golf club head main body consisting of metal, and forming a front opening, with forwardly facing local ledges, b) forging a golf club head face plate consisting of metal, c) connecting the forged face plate to the front of the head main body to close the opening, the connecting including providing fasteners passed through the face plate, and connecting the fasteners to the front of the head main body, proximate the front opening and at said ledges.

In this regard, the a) step of the method may typically include forming bosses proximate the periphery of the front opening, and the c) step includes connecting the fasteners to the bosses; and including grinding frontal extents of the face plate and fasteners to form a forwardly smooth head surface at the face plate.

A further object includes the provision of a golf club metal wood head in accordance with the above.

These and other objects and advantages of the invention, as well as the details of an illustrative embodiment, will be more fully understood from the following specification and drawings, in which:

DRAWING DESCRIPTION

FIG. 1 is a side elevational view of a first embodiment of the invention;

FIG. 1*a* is like FIG. 1 but prior to face plate attachment;

DETAILED DESCRIPTION

Figure 1:
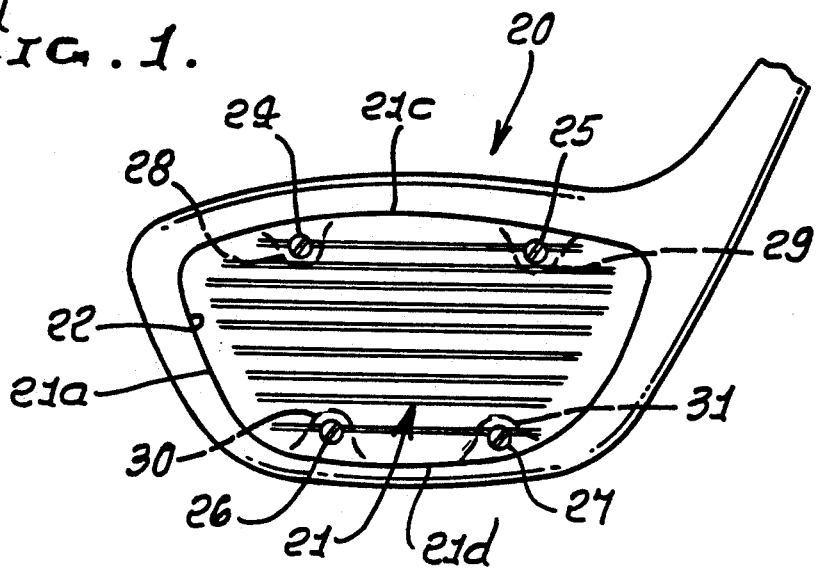
Figure 2:
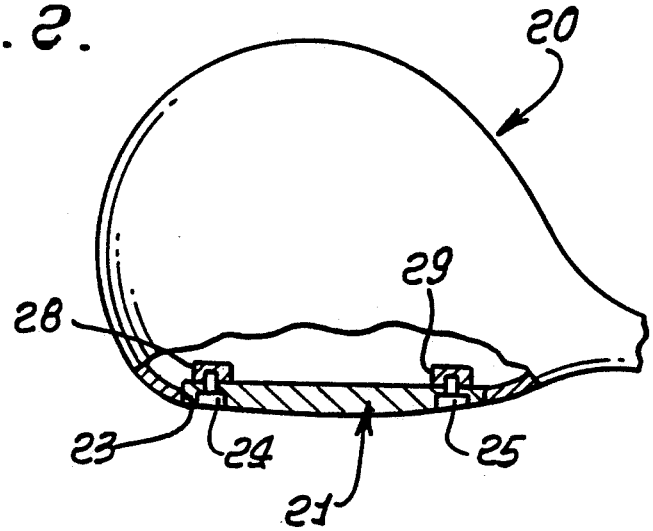
FIG. 2 is a bottom plan view of the first embodiment and cut away to show interior construction.
Figure 3:
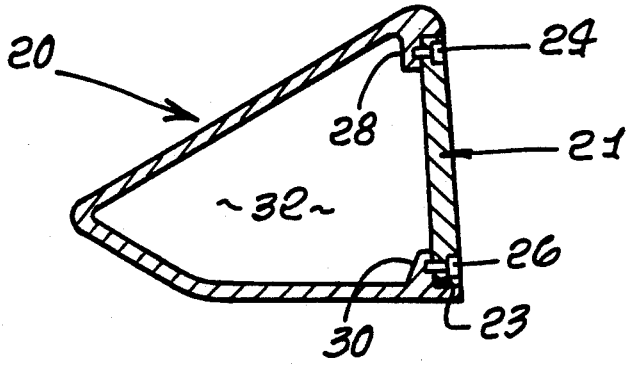
FIG. 3 is an enlarged section showing interior construction.

Referring to FIGS. 1–4, a metal wood golf club head has a main body portion 20 of a first metallic material. It may be formed of investment casting material, such as stainless steel, beryllium copper, titanium, aluminum, etc. The face plate 21 is formed from a second metallic material, and may be forged for high strength, or cast. Preferably, the face plate metal is the same as the main body metal, both typically consisting of stainless steel. The face plate 21 is peripherally abutted against front ledge surfaces of the body and solidly joined to the latter by fasteners, integrating the face plate and body portion.

In the example, the plate 21 has a looping periphery 21*a* fitting closely to or adjacent the looping wall 22 of a front opening 23 in the body, fasteners 24–27 attaching the face plate to ledges 28–31 integral with the body, whereby a high-strength, failure resistant club head (metal wood) is thereby formed. The face plate looping periphery is upwardly convex at edge 21*c*, downwardly convex at edge 21*d*, and generally trapezoidal.

Ledges 28–31 are typically formed during casting of the body 20, and in the form of bosses projecting toward the hollow interior 32 of the head (see FIG. 3), and into registration with the fasteners. Two upper bosses 28 and 29 register with two upper fasteners 24 and 25, near edge 21*c*, and two lower bosses 30 and 31 register with two lower fasteners near edge 21*d*, as shown.

Figure 4:
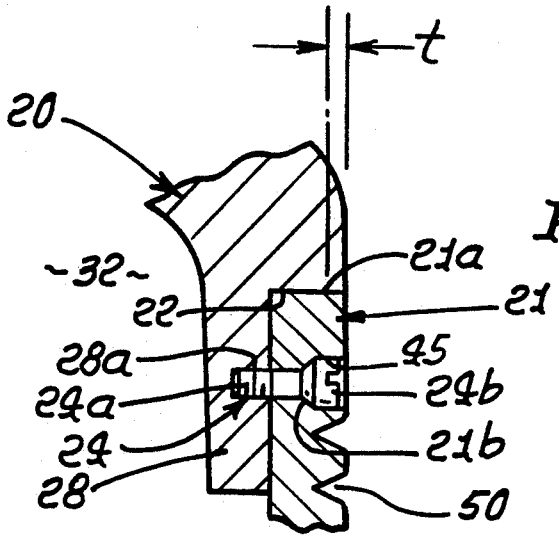
FIG. 4 is an enlarged section showing fastener attachment of a face plate to a head boss.

The fasteners project through openings in the face plate, and into the ledges or bosses, as for example is shown in FIG. 4. Note fastener 24 projecting through an opening 45 formed in plate 21, and into the boss 28'. Fastener threads 24*a* engage threads 28*a* in the boss; and fastener head 24*b* engages countersunk surface 21*a* in the face plate. After connecting all four fasteners into the plate, the fastener heads may be staked in position; and thereafter, the front of the plate is ground to remove a thickness "t" of metal from the plate and from the fastener heads. Such grinding may also reduce somewhat the depth of parallel grooves 50 of the front surface.

Figure 5:
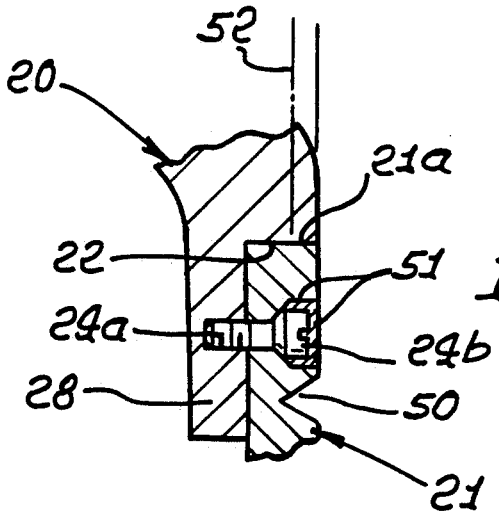
FIG. 5 is an enlarged section like FIG. 4 but showing welding of fastener head to a face plate.
Figure 6:
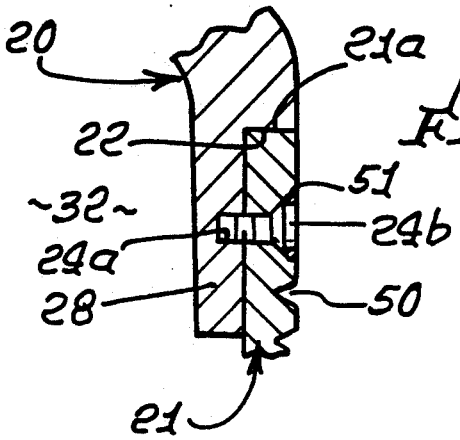
FIG. 6 is a section like FIG. 5 showing the construction after grinding away of a portion of the face plate.

FIG. 5 is the same as FIG. 4, except that welding of the fastener heads to the face plate is employed, weld material being shown at 51, filling clearances between the fastener head and the countersunk recess formed in the face plate. Thereafter, the front of the face plate is ground to a depth indicated by plane 52, FIG. 6 showing the resulting smooth surfaced face plate.

The method of forming the high-strength, metallic, golf club head includes:

a) casting a golf club head main body consisting of metal, and forming a front opening, b) forming a golf club head face plate consisting of metal, c) connecting the metallic face plate to the front of the head main body to close the front opening, the connecting including providing fasteners passed through the face plate, and connecting the fasteners to the front of the head main body, proximate the front opening, as at local ledges integral with the body. The face plate and fastener heads may then be ground to form the finished face plate surface.

Both iron and metal wood golf club heads may be made in accordance with the invention.

A further aspect of the invention includes the provision of the face plate in the form of a high pressure consolidated metallic powder, which is of very high strength. For example, such powder may be consolidated to form a sheet or plate of metallic metal, which is then cut or formed to provide a face plate periphery, as for example of the type shown and described above. Means may then be provided to join the periphery of the formed face plate to the main body portion of cast metal, to form a high strength face plate for the golf club head. The method may then include the following steps:

a) casting a golf club head main body consisting of metal, and forming a front opening, b) forming a golf club head face plate consisting of metal, said forming including providing metallic powder and consolidating said powder under high pressure to form a plate, c) connecting the face plate to the front of the head main body to close said opening.

Such connecting may include providing fasteners passed through the consolidated metal face plate, and connecting the fasteners to the front of the head main body proximate the front opening in that body. Alternatively or in conjunction with such connecting, the periphery of the face plate may be joined to the head main body, as by peripheral welding. One unusually advantageous periphery has generally trapezoidal configuration. The method of consolidating the metal powder may proceed as disclosed in issued U.S. patent Nos., examples being U.S. Pat. Nos. 3,689,259 and 3,356,496.

We claim:

1. A golf club head comprising:

a) a main body portion formed by an investment casting of a first metallic material, said main body portion forming ledges, b) a face plate formed of a second high-strength metallic material and having a periphery, c) and means including fasteners joining the periphery of said face plate to said ledges on said main body portion to form said golf club head, d) the entirety of said face plate formed by said second metallic material being forged.

2. The golf club head of claim 1 wherein said first cast material is a material selected from the group consisting of steel, titanium, beryllium copper, and aluminum, and alloys thereof, and said face plate being the only forged component of said head.

3. The club head of claim 2 wherein said main body portion has a hollow interior, and said ledges protrude into said interior in registration with said fasteners, said fasteners extending from said face plate into said ledges and anchored therein.

4. The golf club head of claim 1 wherein said face plate has a ball-striking front face, and a rear face seated against said ledges which define bosses.

5. The golf club head of claim 1 wherein said main body portion has a front opening that is closed by said face plate, said ledges spaced along a looping periphery defined by said front opening.

6. The golf club head of claim 5 including welding retaining said fasteners to said face plate, which is generally trapezoidal in outline.

7. The golf club head of claim 5 wherein said fasteners comprise two upper fasteners which are spaced apart, and two lower fasteners which are spaced apart, each upper fastener spaced generally above one of the lower fasteners.

8. The golf club head of claim 5 wherein said head has a toe and a heel, and said face plate has a generally trapezoidal periphery, with an upper edge that is convex upwardly, said fasteners including two upper fasteners located near said upper edge and spaced apart in a head toe-to-heel direction.

9. The golf club head of claim 6 wherein said face plate has a lower edge which is generally convex downwardly, said fasteners including two lower fasteners located near said lower edge and spaced apart in a head toe-to-heel direction, said face plate being forged.

10. The golf club head of claim 5 wherein said fasteners are attached to said face plate and said ledges by screw threads.

11. The golf club head of claim 10 wherein said head defines a hollow interior, and said ledges comprise bosses that locally protrude into said hollow interior.

12. The golf club head of claim 5 wherein said face plate also has a looping periphery positioned closely adjacent said opening looping periphery.

13. The golf club head of claim 12 wherein said looping peripheries are generally trapezoidal and which define upwardly convex upper edges, and downwardly convex lower edges, said face plate being forged.

14. The golf club head of claim 1 including welding retaining said fasteners to said face plate, said face plate being generally trapezoidal in outline.

15. The golf club head of claim 1 wherein said face plate consists of a material selected from the group consisting of steel, titanium, beryllium copper, and aluminum, and alloys thereof.

16. The head of claim 1 which consists of an iron.

17. The head of claim 1 which consists of a metal wood.

18. The golf club head of claim 1 comprising said face plate second high strength material consisting of high pressure consolidated metallic powder.

19. A golf club head comprising:

a) a main body portion formed by a casting of a first metallic material, b) a face plate formed of a second high-strength metallic material, c) and means joining the periphery of said face plate to said main body portion to form said golf club head, d) said face plate consisting of high pressure consolidated metallic powder, e) said first and second metallic materials having essentially the same composition.

* * * * *

UNITED STATES PATENT AND TRADEMARK OFFICE

CERTIFICATE OF CORRECTION

PATENT NO. : 5,261,664

DATED : November 16, 1993

INVENTOR(S) : Donald A. Anderson

It is certified that error appears in the above-identified patent and that said Letters Patent is hereby corrected as shown below:

On the title page, [76] Inventor: should read:

--Donald A. Anderson, Huntington Beach, and
Donald J. C. Sun, San Diego, both of California--

Signed and Sealed this

Fourth Day of October, 1994

*Attest:*

*Attesting Officer*

BRUCE LEHMAN

*Commissioner of Patents and Trademarks*